US005232293A

United States Patent [19]

Hibon et al.

[11] Patent Number: 5,232,293

[45] Date of Patent: Aug. 3, 1993

[54] DEVICE FOR THE PREPARATION OF TICKETS

[75] Inventors: Jean-Claude Hibon, Elancourt; Dominique Becker, Beynes, both of France

[73] Assignee: Electronique Serge Dassault, St. Cloud, France

[21] Appl. No.: 930,744

[22] Filed: Aug. 13, 1992

Related U.S. Application Data

[63] Continuation of Ser. No. 299,730, Jan. 19, 1989, abandoned.

[30] Foreign Application Priority Data

Jan. 22. 1988 [FR] France ..... 88 00734

[51] Int. Cl.[5] ..... B41J 5/00; B41J 11/26

[52] U.S. Cl. ..... 400/105; 400/621

[58] Field of Search ..... 400/621, 105, 120, 613, 400/613.1, 613.2, 617, 618, 605, 606, 607.2, 593

[56] References Cited

U.S. PATENT DOCUMENTS

| | | | |
|---|---|---|---|
| 2,084,986 | 6/1937 | Black et al. . | |
| 2,933,038 | 4/1960 | Thut et al. . | |
| 3,662,362 | 5/1972 | Arciprete et al. . | |
| 3,807,264 | 4/1974 | Jeesop . | |
| 3,893,389 | 7/1975 | Kodis . | |
| 3,911,481 | 10/1975 | Andreaggi et al. | 400/105 |
| 3,983,578 | 9/1976 | Price . | |
| 4,216,719 | 8/1980 | Flaceliere et al. | 400/605 |
| 4,234,261 | 11/1980 | Hendrischk et al. . | |
| 4,357,530 | 11/1982 | Roes et al. . | |
| 4,377,828 | 3/1983 | Hayman et al. . | |
| 4,454,517 | 6/1984 | Kagaya . | |
| 4,537,125 | 8/1985 | Gaucher . | |
| 4,639,739 | 1/1987 | Tsutsumi | 400/593 |
| 4,866,256 | 9/1989 | Morofushi . | |
| 4,902,880 | 2/1990 | Garczynsul et al. | 400/105 |
| 4,957,381 | 9/1990 | Saual et al. | 400/621 |

FOREIGN PATENT DOCUMENTS

| | | | |
|---|---|---|---|
| 2912656 | 9/1980 | Fed. Rep. of Germany . | |
| 2042254 | 1/1971 | France . | |
| 2540654 | 8/1984 | France . | |
| 2548804 | 1/1985 | France . | |
| 2566704 | 1/1986 | France . | |
| 0165669 | 9/1984 | Japan | 400/621 |
| 0007366 | 1/1991 | Japan | 400/621 |
| 2106837 | 4/1983 | United Kingdom | 400/621 |
| 2170165 | 7/1986 | United Kingdom . | |

OTHER PUBLICATIONS

Patent Abstract of Japan, vol. 9, No. 70, (M-367) (1793); Mar. 30, 1985.

*Primary Examiner*—Eugene H. Eickholt
*Attorney, Agent, or Firm*—Christie, Parker & Hale

[57] ABSTRACT

The invention comprises: a magazine containing a continuous ticket stock web delimited by weakened lines; a station for applying magnetic inscriptions on a ticket; means for printing on a ticket; an issuing station; and an endless belt wound over rollers, one of which rollers is the driver, to carry a ticket from the magazine as far as the issuing station. The endless belt is provided in the vicinity of the magnetic station and extends as far as a pair of intake rollers, remaining in contact with the end portion of the continuous ticket stock web, the magnetic inscription being effected before the separation of the ticket in question in relation to the continuous stock. A cutting station is positioned between the inscription station and the printing means. This enables, on the one hand, a synchronization of the intake of the tickets with the magnetic inscription and, on the other hand, a simultaneous inscription on a given ticket not yet cut off, as well as printing on the preceding cut-off ticket.

13 Claims, 3 Drawing Sheets

DEVICE FOR THE PREPARATION OF TICKETS

CROSS REFERENCE TO RELATED APPLICATION

This application is a continuation of U.S. patent application Ser. No. 07/299,730, filed Jan. 19, 1989, now abandoned.

FIELD OF THE INVENTION

The present invention concerns the preparation of tickets, in particular airline tickets, comprising magnetic data.

PRIOR ART

Devices are already known for the preparation of airline tickets comprising a magazine, a station for magnetically inscribing a ticket, means for printing on a ticket, and a ticket-issuing station. There are also drive means to carry the ticket along an internal path passing from the magazine to the issuing station. These drive means are at least partly defined by an endless belt wound over rollers, one of which is the driving roller.

Generally the printing means are thermal transfer means provided with a slow processing speed (of the order of 0.9 cm/s) which is much less than that of the magnetic inscription station, in a ratio approximating to 1:10. This results in a lengthy total processing time for the operations necessary for the issuing of an airline ticket.

OBJECTS OF THE INVENTION

It is a first object of the invention to provide a solution for this problem.

Another object of the invention is to provide a device for the preparation of tickets, in particular airline tickets, comprising magnetic data and to do so while allowing a high processing speed to be obtained in spite of the use of slow thermal transfer printing means.

SUMMARY OF THE INVENTION

The invention starts from a ticket preparation device, in particular for airline tickets comprising magnetic data of the type comprising:

a magazine, a station for applying magnetic inscriptions to a ticket, means for printing optically readable information on a ticket, a ticket issuing station, and drive means capable of carrying a ticket along an internal path passing from the magazine as far as the issuing station, these drive means being, at least partly, defined by an endless belt wound internally over rollers, one of which is the driver.

According to a first aspect of the invention, the magazine is capable of containing a continuous ticket stock web delimited by weakened lines, the endless belt is provided at the level of the magnetic inscription station and extends as far as a pair of intake rollers remaining in contact with the end portion of the continuous ticket stock, the magnetic inscription being effected before the ticket is separated in relation to the continuous stock, and there is a cutting station between the inscription station and the printing means, which makes it possible, on the one hand, to synchronise the intake of the tickets with the magnetic inscription and, on the other hand, to effect a simultaneous inscription on a given ticket not yet cut off, as well as printing on the previous ticket that has been cut off.

According to another aspect of the invention, the device comprises, moreover, an additional magazine capable of containing an additional continuous ticket stock web delimited by weakened lines, and a pair of additional intake rollers remaining in contact with the end portion of the said additional continuous ticket stock web; and the two pairs of intake rollers comprise pivoting rollers, which allows a correct intake of the ticket whether it comes from one magazine or the other.

Preferably, the magnetic inscription station comprises a first magnetic inscription head followed by a second immediate magnetic reading head.

According to another characteristic of the invention, the drive means comprise, moreover, an additional endless belt wound over rollers, the said additional belt being provided at the level of the magnetic inscription station, so that the rollers driving the two belts cooperate frictionally to cause a given ticket to pass in front of the said magnetic inscription station.

Preferably, the two belts are driven by a stepping motor.

Suitably, the cutting station comprises an electromagnetic guillotine provided with a blunt edge actuated in liaison with a ticket sensor, while down-line from the cutting station a stretching element keeps the ticket taut, so that the actuation of the cutting station in response to the sensing of the ticket separates the ticket in relation to its continuous stock web along the weakened end lines of the ticket.

Advantageously, the ticket sensor locates the predetermined weakened lines of the said ticket.

According to another characteristic of the invention, the stretching element comprises a drive roller cooperating frictionally with a device for marking colours on the ticket.

According to another aspect of the invention, directing means direct the thus marked and cut ticket down-line from the stretching element onto printing means comprising at least two printing stations mounted in parallel.

Advantageously, each printing station comprises a thermal transfer printing head cooperating with a platen capable of driving the ticket concerned.

According to yet another aspect of the invention, the printing means each comprise a ticket guidance channel fed respectively by the directing means.

According to a preferred embodiment of the invention, there is a storage receptacle for accountancy counterfoils, down-line from the printing means.

According to another embodiment of the invention, provision is made for means for introducing already printed tickets, comprising an intake slot defining an intake channel for the printed tickets and capable of feeding the magnetic inscription station; and ahead of the magnetic inscription station provision is made for a releasing inscription station.

BRIEF DESCRIPTION OF THE DRAWINGS

Other objects and advantages of the invention will emerge from the following detailed description thereof, given with reference to the accompanying drawings wherein.

DESCRIPTION OF A PREFERRED EMBODIMENT

The accompanying drawings comprise many elements which are of a determinate nature. They therefore serve not only to clarify the description given below, but also to contribute to the definition of the invention, if required.

Figure 1:
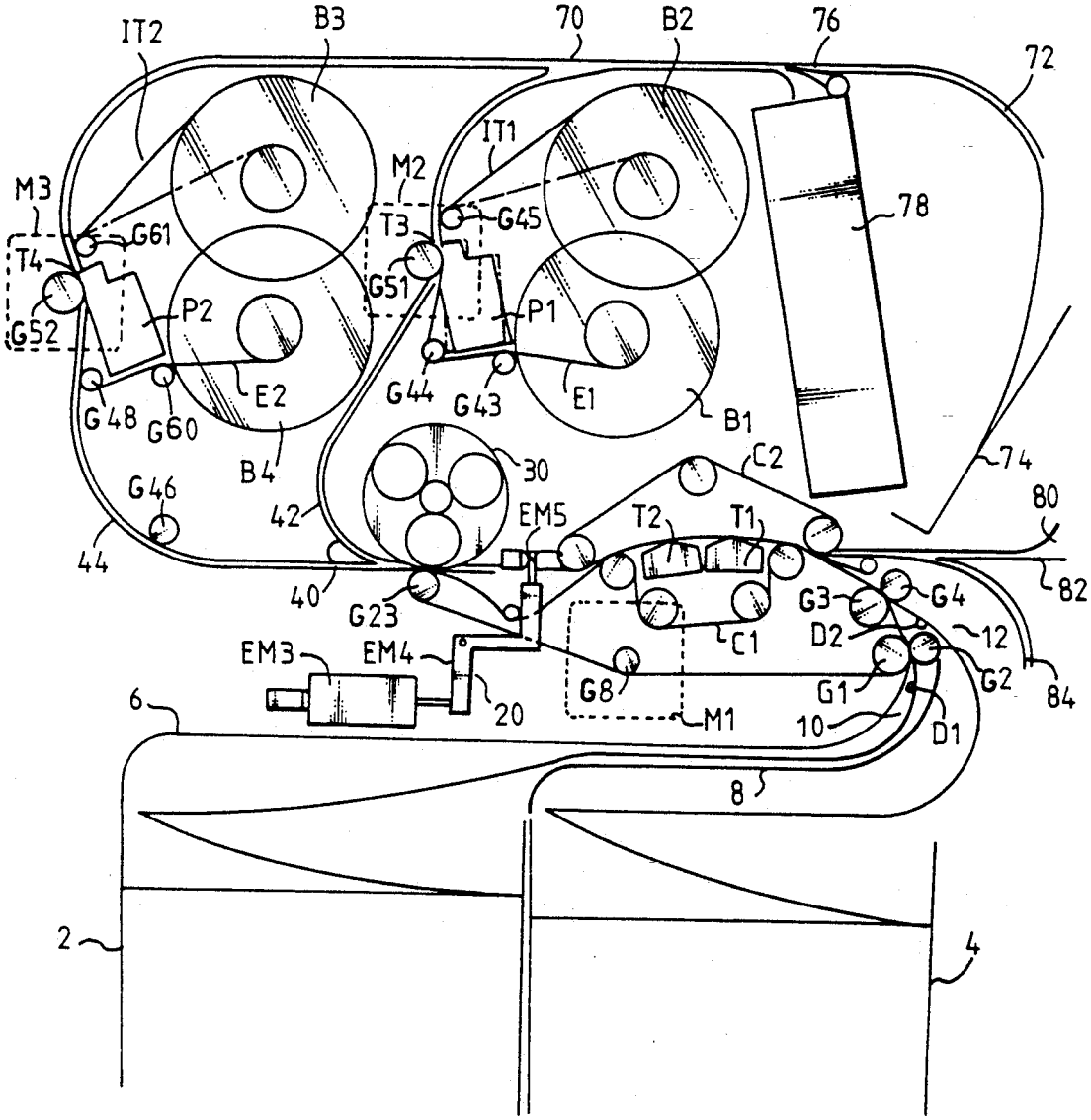
FIG. 1 is a schematic side view of a processing device according to the invention.

As represented in FIG. 1, the present invention uses a double feed of webs stored in a fan-folded form.

Two magazines 2 and 4, each containing a continuous ticket stock delimited by weakened lines, respectively feed towards two intake guides 6 and 8.

The introduction of the webs is effected through two guide channels 10 and 12 converging towards each other and each provided with separate drive means which are here constituted by a pair of releasable intake rollers G1-G2 and G3-G4 described in greater detail below. Sensors such as D1 and D2 determine whether there is any web inserted in each of the intake channels.

Figure 2:
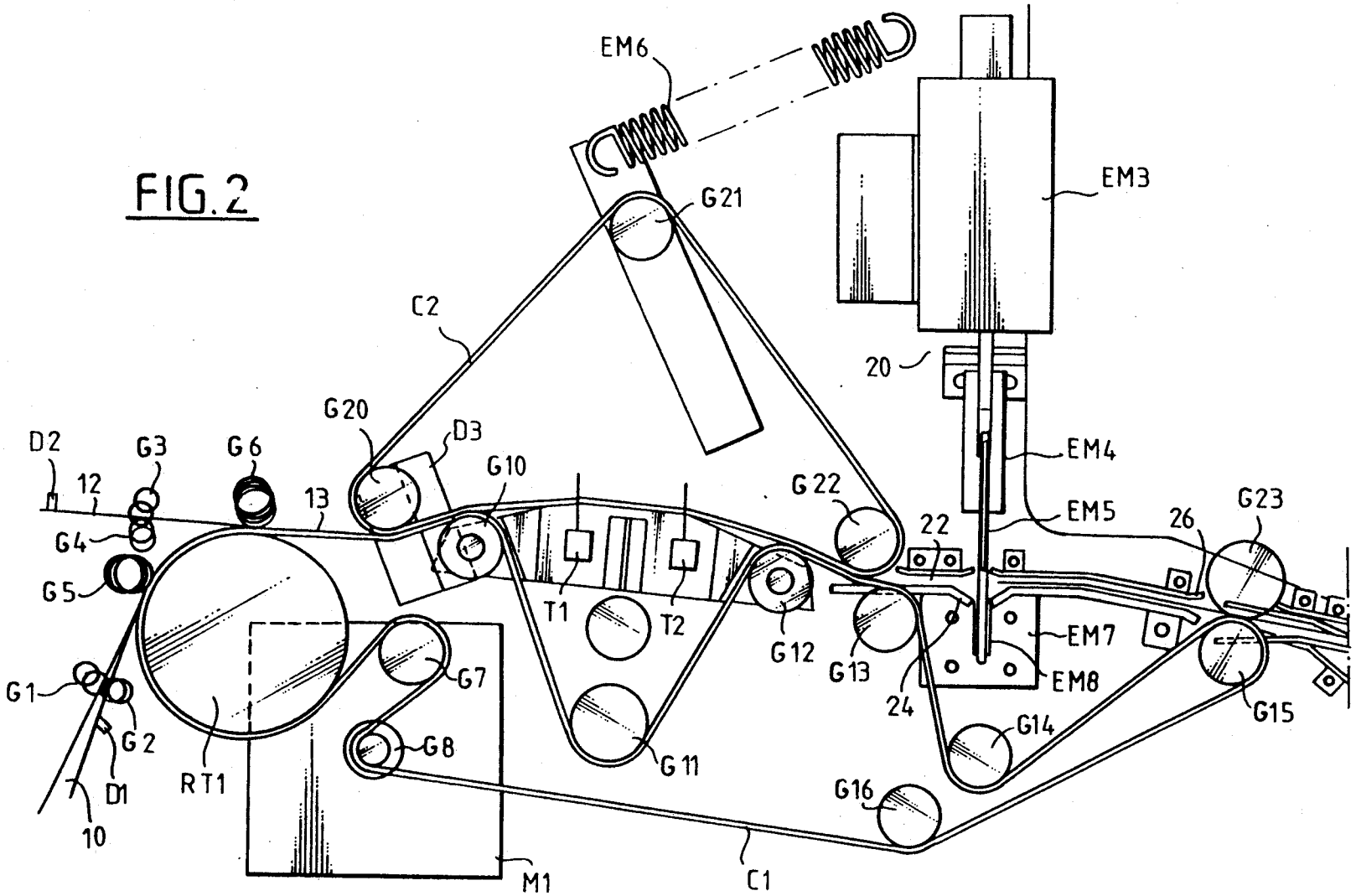
FIG. 2 is a schematic side view of an embodiment of the inscription station preceded by releasable intake rollers, and followed by the cutting station, according to the invention.

Referring now to FIG. 2, there will be seen a preferred embodiment of the portion for the introduction, inscription and cutting of the ticket (this portion is in mirror symmetry in relation to that illustrated in FIG. 1).

The two guide channels 10 and 12 are again shown. The intake channel 10 is defined by the two pivotally mounted rollers G1, G2. A roller G5, associated with the rollers G1, G2, cooperates frictionally with a drum RT1. An endless belt C1 is wound around the drum RT1, over a roller G7 and then over a roller G8 which is mounted on the drive shaft of a stepping motor M1.

The drum RT1 is thus driven by the belt C1. The intake of the web between the pivotally mounted rollers G1 and G2, and then the driving of the web by the cooperation of the roller G5 and of the drum RT1, is effected as follows.

In the drive released or "web blocking" mode, the rollers G1 and G2 are mounted in their closed together position, they cooperate frictionally and hold the web. In this configuration, the web is blocked between the rollers G1 and G2. The roller G5, which is joined to the rollers G1 and G2, is spaced from the drum RT1.

In the drive engaged or "web advancing" mode, the roller G5 cooperates frictionally with the drum RT1 thus allowing the web to be driven by the drum which is driven by the belt C1. To allow the web to pass, the rollers G1 and G2 are kept spaced apart from each other.

To pass from the "web blocking" mode to the "web advancing" mode, the roller G5 is first applied against the drum RT1, then the rollers G1 and G2 are separated from each other.

To pass from the "web advancing" mode to the "web blocking" mode, an elastic restoring action recloses the rollers G1 and G2 together to cooperate with each other, then releases the roller G5 from the drum RT1 to stop the dragging of the web around the drum RT1.

Similarly, the intake channel 12 is defined by the two pivotally mounted rollers G3-G4. A roller G6 associated with the rollers G3-G4 cooperates frictionally with the drum RT1. For driving the web, the roller G6 applies pressure to the drum RT1 while the rollers G3-G4 are apart from each other. The operation of the assembly constituted by the rollers G3, G4, G6 and the drum RT1 is identical to that of the assembly constituted by the rollers G1, G2, G5 and the drum RT1.

The roller assembles G1-G2-G5 and G3-G4-G6 cooperating with the drum RT1 are mounted one behind the other. To ensure that a single one of the two intake channels drives its web to feed it unilaterally at the level of a point of convergence 13 situated down-line from the roller assembly G3-G4-G6, a control unit (not represented) ensures the engaging-releasing actuation of the two rollers G5 and G6 on the drum RT1. In other words, when the roller G5 is engaged with the drive belt C1, the roller G6 is released therefrom, and vice versa.

Figure 3:
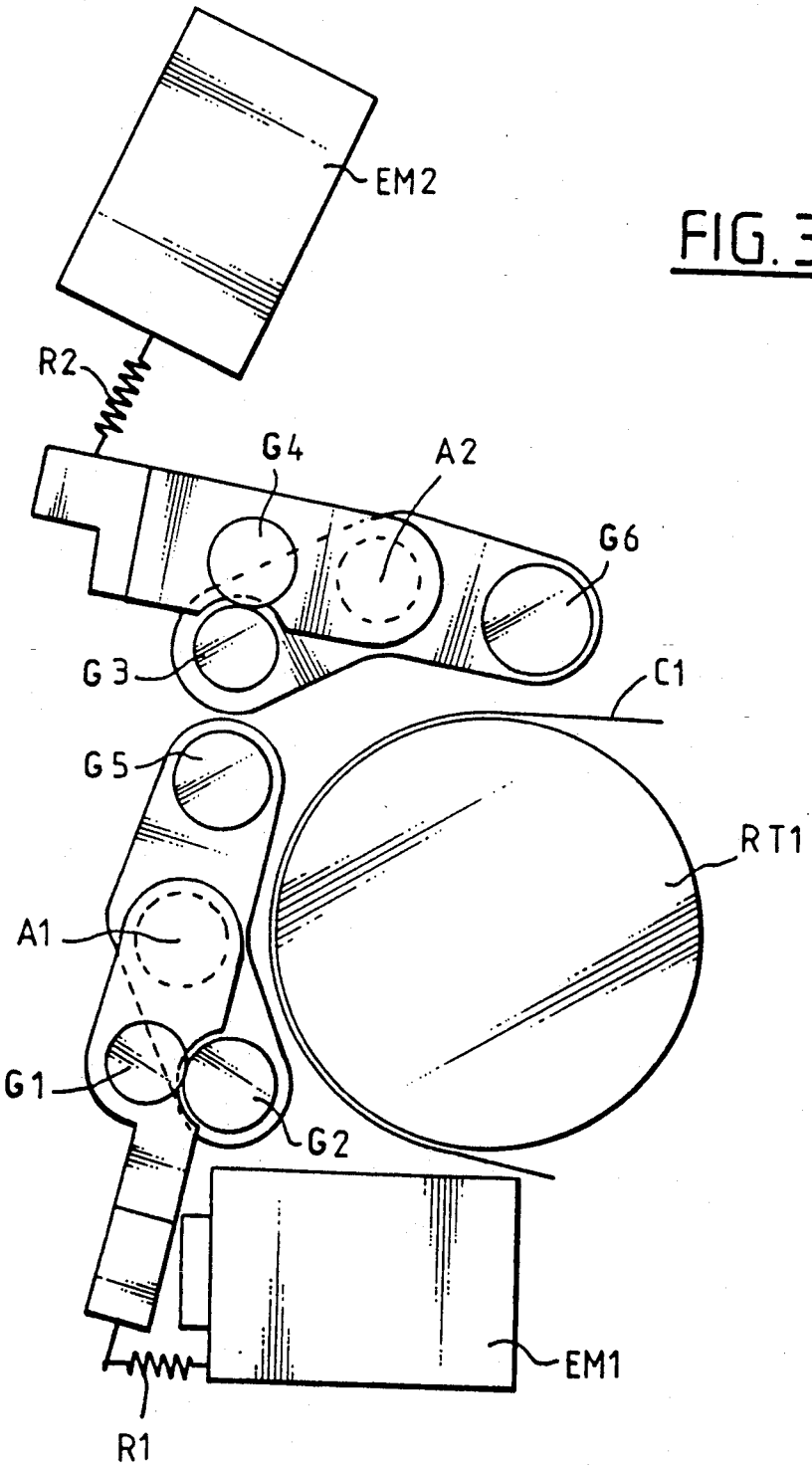
FIG. 3 is a schematic side view of an embodiment of the releasable intake rollers, according to the invention.

Reference will now be made to FIG. 3 which illustrates the mechanical actuation of the two intake roller assemblies G1-G2-G5 and G3-G4-G6 in greater detail.

The rollers G1-G2 are shown as each being mounted for pivoting around an axis of rotation A1. The roller G5 which is associated with the rollers G1 and G2 is shown clear of the drum RT1 and drive belt C1, while the rollers G1 and G2 are touching one another.

An electromagnet EM1 pushes the assembly G1-G2-G5 to place it into the "web advancing" configuration. Conversely, an elastic restoring member R2 returns the assembly G3-G4-G6 to place it into the "web blocking" configuration.

Similarly, an electromagnet EM2 pulls the assembly G3-G4-G6 to place it into the "web advancing" configuration. Conversely, an elastic restoring member R2 returns the assembly G3-G4-G6 to place it into the "web blocking" configuration.

Referring now again to FIG. 2, the two paths or intake channels 10 and 12 can be seen as converging towards the point 13 behind the roller G6. They can, therefore, advance one or other of the webs to this position.

The web is then passed in front of a magnetic inscription station comprising a first magnetic inscription head T1 followed by an immediate second magnetic reading head T2. As a variant, the magnetic inscription station may only comprise a single magnetic head, in which case, the web will pass back and forth several times in front of that single head.

From the drum RT1, the belt C1 is wound over the roller G10, turns at right angles towards the roller G11 to avoid the heads of the inscription station, and is then wound over the roller G12 to continue the internal path. As indicated above, the belt C1 is driven in a closed system by means of the driving roller G8 on the drive shaft of the stepping motor M1.

Another endless belt C2, situated opposite the belt C1, allows the web to be driven frictionally in front of the magnetic heads T1 and T2. The belt C2 is wound over the roller G20, and then turns at right angles over the roller G21 to avoid the heads T1 and T2, and is finally wound over the roller G22.

The belts C1 and C2 cooperate frictionally in the vicinity of the rollers G10 and G20 and again at the rollers G12 and G22 to cause the web to pass in front of the heads T1 and T2.

Thus a path of contact is defined between the two belts C1 and C2.

Once the magnetic inscription of the data on a given ticket has been completed, followed by its immediate reading by the head T2, the web is carried along a guide channel 22 past a cutting station 20. The guide channel 22 cooperates at its downstream lip 24 with the cutting station 20.

The cutting station 20, having an electromagnetic guillotine, comprises an electromagnet EM3 having a plunger EM4 which supports the cutting blade EM5 of the guillotine. The cutting blade EM5 has a blunt edge cooperating with an anvil block EM7 having a central slot EM8 on which the cutting component EM5 bears. An elastic restoring member EM6 fastened to the plunger EM4 allows the cutting component EM5 to be returned into its normal raised position (in FIG. 2, the EM5 component is illustrated in the cutting position).

There is an extension of the straight guide channel 22 behind the cutting station 20, as far as an outlet lip 26 which cooperates with a roller G23.

Behind the roller G13, the belt C1 turns at right angles around the roller G14 to avoid the cutting station 20 and is then wound over the roller G15, redescends towards the roller G16, and passes over the drive roller G8 on the drive shaft of the motor M1.

The web is kept stretched on one side between the two rollers G22 and G13 and on the other side between the two rollers G23 and G15, to allow the ticket to be separated in relation to its continuous stock along the weakened lines at the ends of the tickets. This separation is effected by causing the blunt edge EM5 to be lowered onto the web which is thus kept stretched. The blunt edge EM5 can be actuated in combination with a ticket sensor D3 mounted ahead of the magnetic inscription station. The ticket sensor can, for example, locate the predetermined weakened line of the ticket in order to actuate the guillotine.

Once the cutting has been completed on the ticket concerned, the ticket passes the downstream lip 26 of the guide 22 towards the printing means, to be described in greater detail below, for printing optically readable information. A new ticket can be inserted in front of the magnetic inscription station as well as in front of the cutting station.

Reference will now again be made to FIG. 1. The stretching device described above with reference to FIG. 2 and constituted by rollers G23 and G15 can be replaced by a colour marking device 30 cooperating frictionally with the roller G23. The colour marking can comprise the marking of three colours necessary for the personalisation of the airline tickets.

Down-line from the stretching device defined by roller G23 and colour marking device 30, there are movable directing means 40 allowing the ticket thus marked and cut to be directed towards the printing means.

On leaving the stretching device G23-30, the severed ticket is directed by the directing means 40 either towards a guide channel 42 leading it towards a first printing station IT1, or towards a second guide channel 44 leading it towards a second printing station IT2.

The guide channel 42 is defined by a passage into which the ticket passes, pushed by the stretching device 30-G23 which is driven by the belt C1. The guide channel 42 leads the ticket in front of the printing station IT1 comprising a printer body Pl extended in a printing head T3 cooperating frictionally with the roller G51 performing the function of a platen for the printing head T3. The roller G51 is driven by a motor M2.

The printing station IT1 is of the thermal transfer type. An inking ribbon E1 wound round the cores of two reels B1 and B2 passes in front of the printing head T3 along a path defined by the rollers G43, G44 and G45.

Similarly, the guide channel 44 is defined by a passage into which the ticket passes as it is pushed by the driving device 30-G23 which is driven by the belt C1. A roller G46 helps to advance the ticket. The guide channel 44 leads the airline ticket in front of the printing station IT2 comprising a printer body P2 extended in a printing head T4 cooperating with a roller G52 serving as a platen for the printing head T4. The roller G52 is driven by a motor M3.

The printing head IT2 is of the thermal transfer type. An inking ribbon E2 wound around the cores of two reels B3 and B4 is wound around the rollers G60, G48 and G61 to pass in front of the printing head T4.

The printing heads T3 and T4 are pivotally mounted. In their advanced positions the pressure exerted by the printing heads T3 and T4 on their respective platens G51, G52 allows the tickets to be driven past the printing heads T3 and T4. In their retracted positions the printing heads T3 and T4 do not cooperate with their respective platens G51 and G52, thereby allowing the tickets to be introduced to the printing stations IT1 and IT2.

The pivoting of the printing heads T3 and T4 is actuated by a respective electromagnet (not represented).

The pressure exerted by the heads T3 and T4 on their respective platens G51, G52 is at its maximum when the normals defined by the pairs G51-T3 and G52-T4 are perpendicular to the internal path of the ticket.

This exerted pressure is sufficient to prevent the ticket from sliding during printing.

For example, the printing stations IT1 and IT2 are thermal printers sold by the MITSUBISHI Company of Japan, under reference number N56-8E-S.

The guide channels 42 and 44 are extended behind the printing stations IT1 and IT2 to converge at a point 70. Immediately downstream of the point 70, provision is made for a ticket outlet device 72 issuing into an outlet receptacle 74. A movable directing means 76 mounted downstream of from the convergence point 70 also makes it possible to lead a docket, for example the accountancy counterfoil of the airline ticket towards a storage receptacle 78 inside the device.

The directing means 40 are actuated by the control unit so as to lead the ticket in question alternately in front of the printing stations IT1 and IT2.

The control unit also controls the directing means 76.

According to a variant of the device in accordance with the invention, there may be means for the introduction of already printed tickets, comprising an intake slot 80 defining an intake channel 82 feeding the magnetic inscription station. Upstream of the inscription station there may be a releasing channel 84 to allow the to and fro ticket movement in front of the inscription station.

The present invention is, of course, not limited to the embodiment described, but on the contrary it extends to any variant comprised within the scope of the following claims.

We claim:

1. In a device for the preparation of tickets, which comprise magnetic data, said device comprising:

(a) a first magazine shaped to contain a continuous stock web of ticket delimited by weakened lines, (b) a station for magnetically inscribing a ticket, (c) a cutting station downstream to said magnetic inscribing station, (d) stretching means downstream to said cutting station, and comprising at least a roller, (e) first drive means effective to drive a ticket along a first internal path passing from said magazine as far as said roller of said stretching means, said first drive means being, at least partly, defined by a first endless belt wound over rollers, one of which is the drive roller for the first endless belt, said first endless belt being arranged from the vicinity of said magnetic inscription station, extending to a first pair of intake rollers which are operable to remain optionally in contact with the end portion of said continuous ticket stock web, winding round said rollers to avoid the cutting station and round the roller of the stretching means;

(f) means for printing optically readable information on a ticket;

(g)

a ticket issuing station;

(h) second drive means effective to drive a ticket along a second internal path passing from said roller of the stretching means as far as said issuing station, said second drive means comprising guide channel means and a platen drive roller;

(i) control means for adjusting the speeds and phases of said first and second drive means for allowing synchronizing of the intake of the tickets with the magnetic inscription operation simultaneous inscription on a given ticket not yet cut off, as well as printing on a previously cut off ticket.

2. A device according to claim 1, and further comprising a second said magazine capable of containing an additional continuous ticket stock web delimited by weakened lines, and a second pair of intake rollers operable to remain optionally in contact with the end portion of the said additional continuous ticket stock web; and wherein said first and second pairs of intake rollers each comprise pivoting rollers for allowing a correct intake of the tickets, whether they come from said first or said second magazine.

3. A device according to claim 1, wherein said magnetic inscription station comprises an inscribing first magnetic head immediately followed by a reading second magnetic head.

4. A device according to claim 1, wherein said drive means further comprise a second endless belt wound over second rollers, said second endless belt being provided in the vicinity of the magnetic inscription station, so that the first and second rollers driving the first and second endless belts cooperate frictionally to cause a given ticket to pass in front of said magnetic inscription station.

5. A device according to claim 4, including stepping motor means for driving said first and second endless belts.

6. A device according to claim 1, wherein said cutting station comprises:

(i) an electromagnetic guillotine provided with a blunt edge;

(ii) actuating means and a ticket sensor arranged in combination for actuating said electromagnetic guillotine; and (iii) down line from the cutting station, said stretching means keeping the ticket taut so that the actuation of the cutting station in response to the sensing of the ticket by said ticket sensor separates the ticket from said continuous stock web along said weakened end lines of a said ticket.

7. A device according to claim 6, wherein said ticket sensor is operative to locate said predetermined weakened lines of a said ticket.

8. A device according to claim 6, wherein said stretching means comprise a drive roller cooperating frictionally with means for marking colors on the ticket.

9. A device according to claim 8, including directing means, down-line from said stretching means, operative to direct a thus marked and cut said ticket, onto said printing means comprising at least two printing stations arranged in parallel.

10. A device according to claim 9, wherein each said printing station comprises a thermal transfer printing head and a cooperating platen capable of driving a said ticket.

11. A device according to claim 9, wherein each said printing station comprises a respective guide channel, and wherein said directing means directs a said ticket to either one of said guide channels.

12. A device according to claim 1, including a storage receptacle for receiving accountancy counterfoils, down-line from the printing means.

13. A device according to claim 1, including means for introducing already printed tickets, said means comprising guide means defining an intake channel capable of feeding tickets to the magnetic inscription station; and means including a releasing channel ahead of the magnetic inscription station, allowing the to and fro ticket movement in front of the inscription station.

* * * * *